United States Patent [19]

Gunderson

[11] 4,306,845

[45] Dec. 22, 1981

[54] ROLLING ROTOR EXPANSIBLE CHAMBER MACHINE WITH ROLLING SEAL CYLINDER

[76] Inventor: Raymond L. Gunderson, P.O. Box 132, Cayucos, Calif. 93430

[21] Appl. No.: 42,347

[22] Filed: May 25, 1979

[51] Int. Cl.[3] ..... F01C 1/02; F01C 19/00

[52] U.S. Cl. ..... 418/57; 418/63; 418/139; 418/225

[58] Field of Search ..... 418/57, 63, 139, 225

[56] References Cited

U.S. PATENT DOCUMENTS

| | | | |
|---|---|---|---|
| 134,294 | 12/1872 | Lamb et al. | 418/225 |
| 1,471,761 | 10/1923 | Weidenbach | 418/225 |
| 1,700,038 | 1/1929 | Feverheerd | 418/225 |
| 2,341,231 | 2/1944 | Nordling | 418/63 |

FOREIGN PATENT DOCUMENTS

| | | | |
|---|---|---|---|
| 41438 | 12/1887 | Fed. Rep. of Germany | 418/225 |
| 2414941 | 10/1975 | Fed. Rep. of Germany | 418/225 |
| 342943 | 7/1904 | France | 418/225 |
| 804023 | 7/1936 | France | 418/63 |
| 274220 | 7/1927 | United Kingdom | 418/57 |

*Primary Examiner*—John J. Vrablik

*Attorney, Agent, or Firm*—Harry W. Brelsford

[57] ABSTRACT

A housing has a cylindrical interior which has a peripheral seal chamber parallel to the cylinder axis. Inlet and exhaust ports are formed in the housing, preferably in or near the seal chamber. These ports are sealed from each other by a freely rolling cylinder which rolls on a rolling piston cylinder mounted on a shaft with an eccentric and with a bearing between the eccentric and the piston. The rolling seal also engages the seal chamber, and to reduce friction a rotatable support on a fixed axis is disposed in the seal chamber and in turn is sealed by a rubbing seal to the seal chamber wall. The rolling seal cylinder retreats into the seal chamber when the piston cylinder reaches the region of the seal chamber. This structure eliminates prior art rubbing seals which engaged the rolling piston.

4 Claims, 7 Drawing Figures

ROLLING ROTOR EXPANSIBLE CHAMBER MACHINE WITH ROLLING SEAL CYLINDER

This invention relates to rolling rotor machines which may be used as a motor or a pump or an engine.

BACKGROUND OF THE INVENTION

Many different designs have been made over the years for rolling piston or rolling rotor motors and pumps, but these have the commercial drawback of a mechanical rubbing seal at the periphery of the rolling piston. The seal wears with use, thereby limiting the life of the apparatus and necessitating a tear down for seal replacement.

There is a commercial need for a rotary piston or rolling rotor machine wherein the seal is absent or is out of contact with the main rotor or piston so that there is freedom from frequent seal replacement.

SUMMARY OF THE INVENTION

I have devised a rolling piston machine in the form of a cylinder that rolls on the inside of a cylindrical drum. The piston is freely rotating and power may be applied to it or taken off it by an eccentric on a shaft having a fixed bearing or by a flexible shaft or other mechanism. The shaft is rotated by outside power when the engine acts as a pump, and the apparatus rotates the shaft when the apparatus operates as a motor. All machined surfaces are circular for ease in manufacture compared to eccentric parts in the prior art.

An inlet and outlet are located at or near an outwardly projecting seal chamber at one point on the cylindrical drum or housing, and a freely movable and freely rolling cylinder seals the rotary piston between the inlet and outlet. This seal chamber is preferably elongated parallel to the drum axis. This freely floating cylinder acts as the seal for the piston, and by this means I avoid wear on a seal in contact with the piston. A third roller may be employed to seal in contact with the piston. A third roller may be employed to seal the rolling seal cylinder, and this third roller may have a fixed axis and have a conventional seal on its periphery. It may be described as a rotating support. By making the third roller or support small in diameter and fixing its axis of rotation, the wear on the conventional seal is minimized.

I distinguish between these three cylinders by referring to the large cylinder as a piston, by referring to the cylinder that retreats into the seal chamber as the "rolling" cylinder, and by referring to the fixed roller as a support.

DETAILED DESCRIPTION

Various objects, advantages, and features of the invention will be apparent in the following description and claims, considered together with accompanying drawings forming an integral part of this specification and in which:

Figure 1:
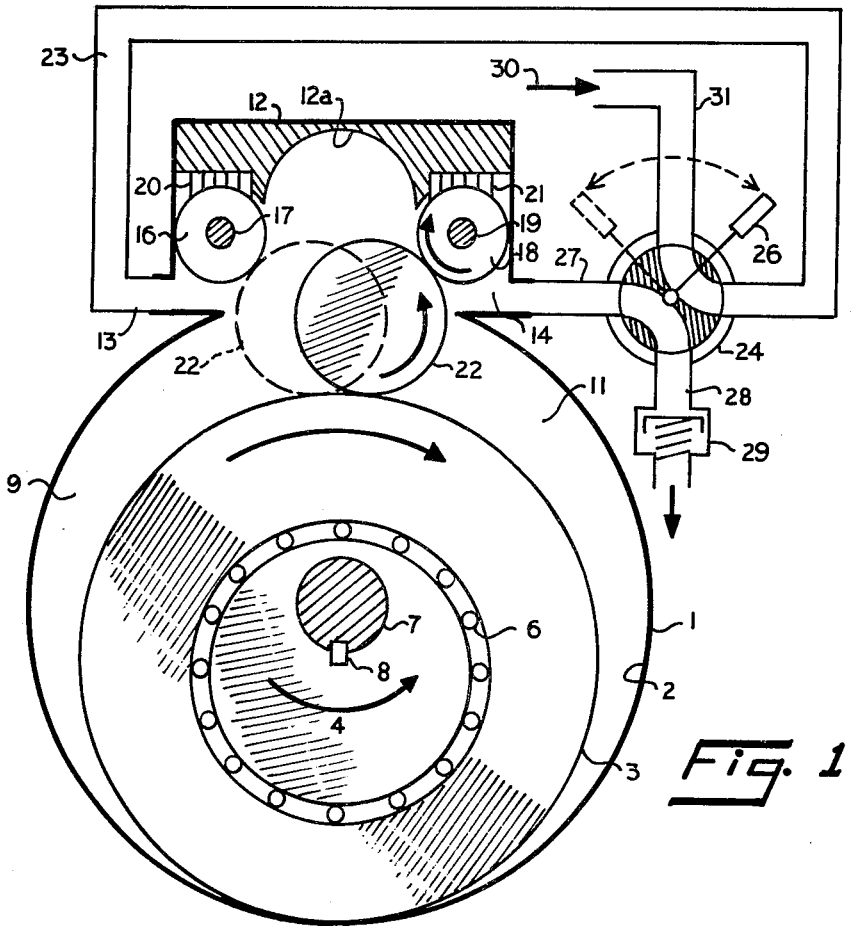
FIG. 1 is a schematic diagram of a rolling cylinder apparatus embodying the invention wherein there is a rotating support at both the inlet and outlet so that the apparatus is reversible and the inlet and outlet are connected to a reversinng valve.

Referring to FIG. 1, there is illustrated a housing 1 having a circular cylindrical interior 2 in which rolls a circular piston cylinder 3 having an outside diameter that is less than the interior diameter of the interior 2. The rolling piston 3 is mounted on an eccentric 4 which engages the piston 3 by virtue of roller or ball bearings 6. The eccentric in turn is mounted on a fixed shaft 7 connected by a key 8 to the eccentric 4.

Working chambers are developed within the cylindrical interior 2, and one such working area or volume of displacement is designated as 9 to the left of the rolling piston 3, and the other working volume is designated as 11 on the right of the piston 3. The housing 1 is formed with an outwardly extending seal chamber 12, and in the side wall of the seal chamber is an inlet port 13 and an outlet port 14. Disposed above and adjacent to the inlet port 13 is a seal support 16 which is mounted on a fixed axis 17 and which is sealed with relation to the seal chamber 12 by means of a conventional seal such as a labyrinth seal 20. Disposed above the outlet port 14 is a similar cylindrical support 18 mounted on a fixed axis 19 and sealed to the seal chamber 12 by a rubbing seal such as a labyrinth seal 21.

The inlet is sealed from the outlet by a freely rotatable cylinder 22 which rolls on the top of the piston 3 and for this reason is referred to as the rolling cylinder. The rolling cylinder 22 also engages the seal support 18 to complete the seal between the inlet 13 and outlet 14.

Connected to the inlet 13 is a conduit 23, which leads to a reversing valve 24, operated by a handle 26. The outlet 14 is connected by a conduit 27 to the reversing valve 24, and this valve 24 connects it further to an outlet conduit 28, having a check valve 29 located therein. Also connected to the reversing valve 24 is a conduit 31 leading to a source of fluid under pressure 30 which may be liquid or gas.

The operation of the schematic device of FIG. 1 is as follows: fluid under pressure flows through the conduit 31 to the reversing valve 24 where it is then directed through the conduit 23 to the inlet 13. This fluid under pressure is prevented from reaching the outlet 14 because of the rolling seal 22 and the supporting cylinder 18. This fluid under pressure, therefore, flows into the working area 9, which exerts a pressure toward the right in FIG. 1, which pushes the lower part of the eccentric 4 to the right and causes the piston 3 to rotate in a clockwise direction, which in turn causes it to roll up the right side of the cylindrical interior 2. The pressure in working cavity 9 continues to push on the piston 3 as the working area is increased in volume until the piston rolls up to the region of the seal chamber 12, whereupon the rolling cylinder 22 retreats upwardly by a rolling action into a semi-cylindrical cavity **12*a* in the chamber 12. As the piston 3 rolls further in its counter clockwise displacement, it seals off the inlet 13, and the fluid in the working space 9 and below the piston 3 now is free to flow to the outlet 14. As the piston 3** revolves about its shaft 7, it will scavenge the working area 9, forcing the fluid ahead of the piston to the outlet 14. As the piston 3 drops downwardly, the rolling seal 22 will stay in contact with the rotating support 18 because of the pressure of inlet fluid forcing the rolling seal 22 to the right. In this fashion, the cycle will start all over again.

Preferably, two such machines operated as motors should be connected on the same shaft 7, but 180 degrees out of phase so that one will be generating power to help the other scavenge during its nonpower phase.

While the machine of FIG. 1 could operate unidirectionally as just described, it can be made reversible; for this purpose, the lever 26 on the valve 24 may be rotated 90 degrees counter clockwise to connect the outlet 14 to the supply conduit 31 and to connect the inlet conduit 23 to the exhaust 28. The inlet 13 thereupon becomes the outlet and the outlet 14 thereupon becomes the inlet, and the force of fluid causes the rolling seal to move to the left as shown in the broken outline to engage the rotating support 16. The cycle may then be repeated, causing the shaft 7 to rotate in the opposite direction.

It is well known to those skilled in the art that any such engine or motor may be operated as a pump. For this purpose, a motor is connected to the shaft 7, which in turn drives the rolling piston 3. With regard to FIG. 1, if the apparatus acts as a pump and the shaft 7 causes a movement in the direction of the arrows on the piston 3, the eccentric 4, the rolling seal 22, and the rotating seal support 18, the arrow 30 then becomes a source of fluid to be pumped. Again, 13 becomes the inlet for this fluid, and as the piston 3 rolls upwardly on the right-hand side of the cylindrical interior 2, the working space 9 expands, causing suction which will fill this working space. When the piston 3 arrives at the top of the cylinder interior 2, the inlet 13 is sealed off, the rolling cylinder 22 engages the lefthand rotating support 16, and the compression stroke then begins to force the fluid in the working cavity 9 to the right underneath the piston 3. The piston 3, accordingly, rolls around the interior 2 from the inlet 13, forcing the fluid ahead because the inlet is now sealed off. The compression stroke is finished when the piston 3 again rides up to the top of the interior 2; the rolling seal 22 will again retreat upwardly into the semicylindrical recess 12*a*.

FIGS. 2 AND 3

Figure 3:
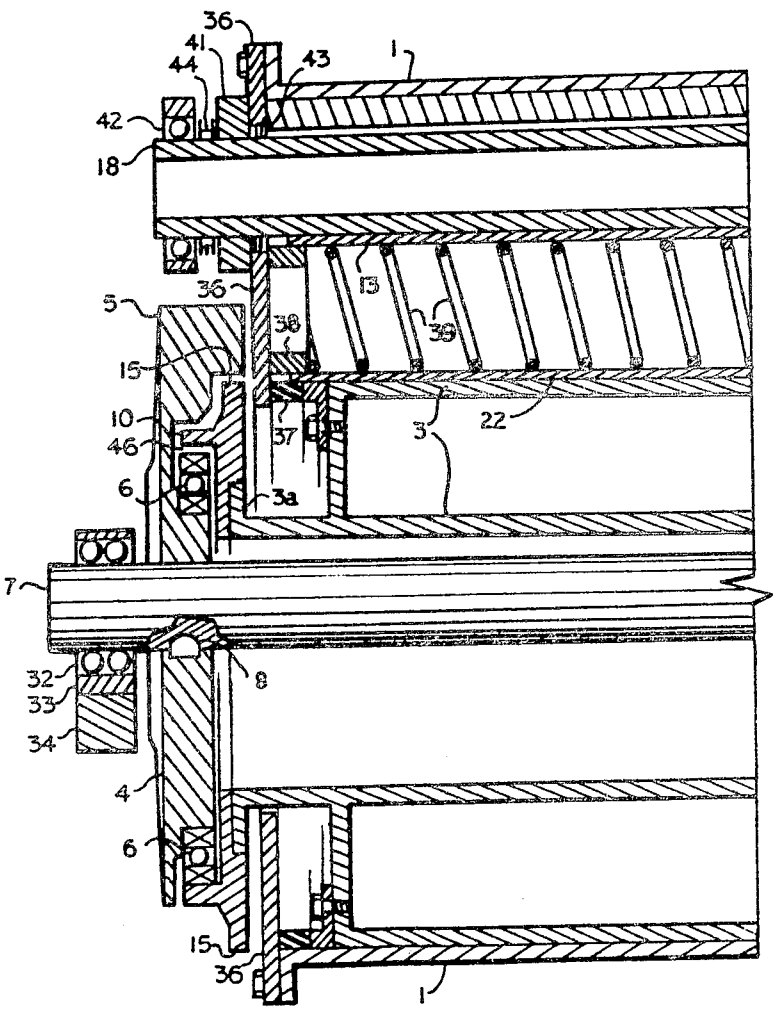
FIG. 3 is a sectional view along the line III—III of FIG. 2.
Figure 2:
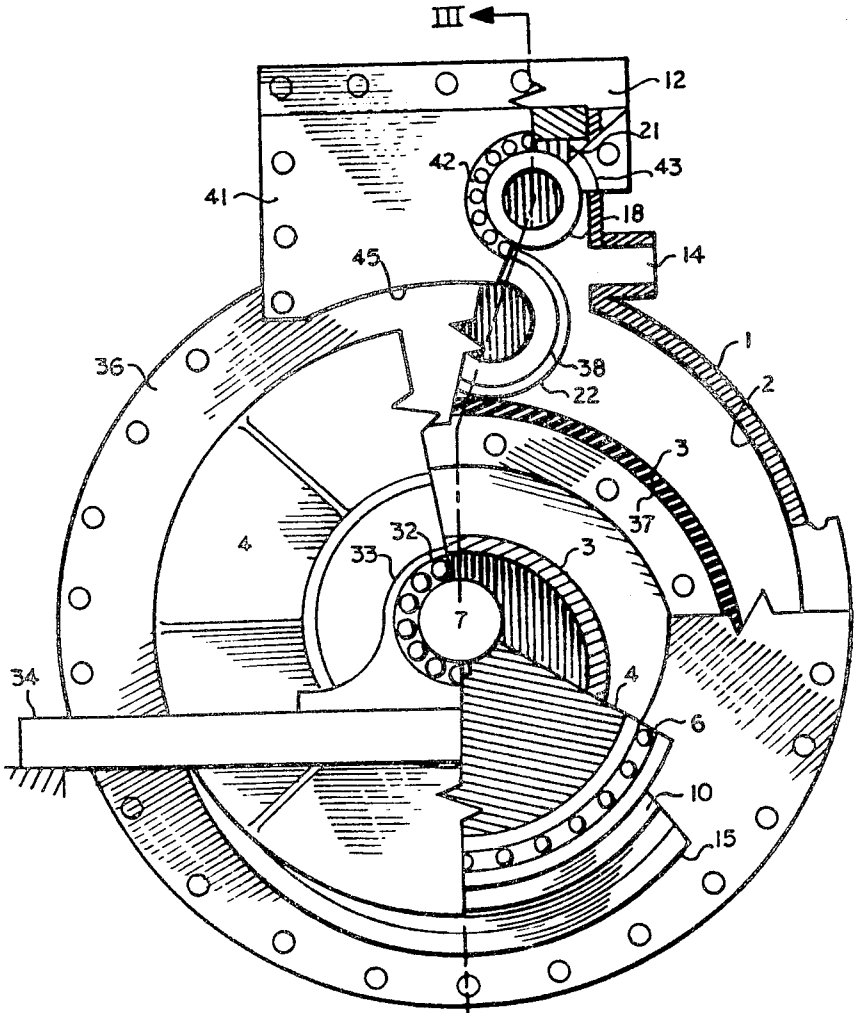
FIG. 2 is an end view of a realistic apparatus embodying the mechanisms shown schematically in FIG. 1.

Referring to FIGS. 2 and 3, it will be noted that the shaft 7 is supported on a bearing 32, which in turn is supported by a bearing block 33 mounted on a transverse rod 34.

Referring to FIG. 3, it will be noted that the eccentric 4 is keyed to the shaft 7 by the key 8, but opposite the long end of the eccentric 4 is a counter balance 5 as shown above the upper part of the bearing 6. This counter balance 5 counteracts the excess weight of the eccentric 4 with respect to the center of the shaft 7.

Referrinng still to FIG. 3, the outer part of the bearing 6 is engaged by a ring 10, which is secured to an outwardly extending flange 3*a* of the rotor or piston 3. Extending outwardly from the ring 10 is a radial rim 15 of the same diameter as the rolling piston 3.

Secured to the outer end of the housing 1 is an end plate or cover 36 which closes off the ends of the working chambers 9 and 11 illustated in FIG. 1. Both the rolling piston 3 and the rolling seal 22 abut against this end plate 36, and the piston 3 has an annular seal 37 which abuts against this end plate 36. The rolling seal cylinder 22 has a ring seal 38 telescoping within the ends of this hollow tubular rolling seal 22, and the seals at each end of this hollow tube are urged into engagement with the respective end plates 36 by a compression spring 39. The rotating support 18, however, must roll accurately within bearings, and the bearings need to be protected to some extent by the internal heat of the entire device, especially when it is used as an internal or external combustion engine. For this purpsoe, the support 18 passes through a bridge 41 secured to the end plate 36 and is supported by a bearing assembly 42, the supports for which are not shown. Disposed in the end plate 36 is a seal 43 around the support 18 and the bridge 41 holds this in place. Also, if desired, a slinger ring 44 may be employed to keep fluids from reaching the bearing 42.

It will be appreciated by those skilled in the art that the other end of the engine may be identically constructed to the cross section shown in FIG. 3 and to the end view shown in FIG. 2.

The function of the bridge 41 is to provide a rail or bearing surface which supports the revolving piston cylinder 3 in the region of the seal chamber 12. For this purpose, the bridge has a circular lower edge 45, which is the exact diameter and curvature of the interior 2 of the housing 1. The rim 15 on the piston flange rides on this circular track 45, for which reason the piston 3 does not penetrate the interior of the seal chamber 12.

Referring now to FIG. 3 and the ring flange 10, it will be noted that above the shaft 7 there is an air space 46 between the outer race of the bearing 6 and the ring flange 10. This is a deliberate tolerance introduced so that the piston 3 will be in rolling contact with the interior 2 of the housing 1. The piston 3, therefore, is not suspended by its bearing 6. In the region of the seal chamber 12, there is no interior surface 2 on which the piston 3 rolls, and this bridge 41 provides such a rolling surface, as explained, for the rim 15.

Figure 4:
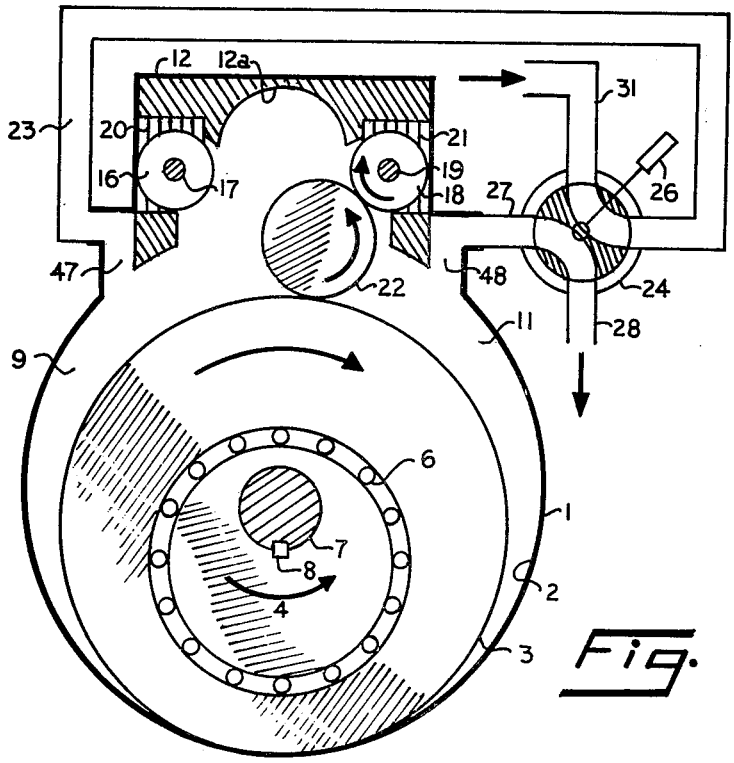
FIG. 4 is a schematic diagram of a modified form of apparatus similar to that of FIG. 1, but wherein the ports are located at a different position.

Referring now to FIG. 4, the similar parts identified in FIG. 1 are designated with the same numerals. However, the ports to the housing are different, and an inlet port 47 opens directly into the working chamber 9 and an outlet port 48 opens directly into the working chamber 11. The operation of FIG. 4 is similar to that of FIG. 1. While the two ports could be located at any separated points on the housing 1, the efficiency is greatest when they are located near to the seal cylinder 22.

Figure 5:
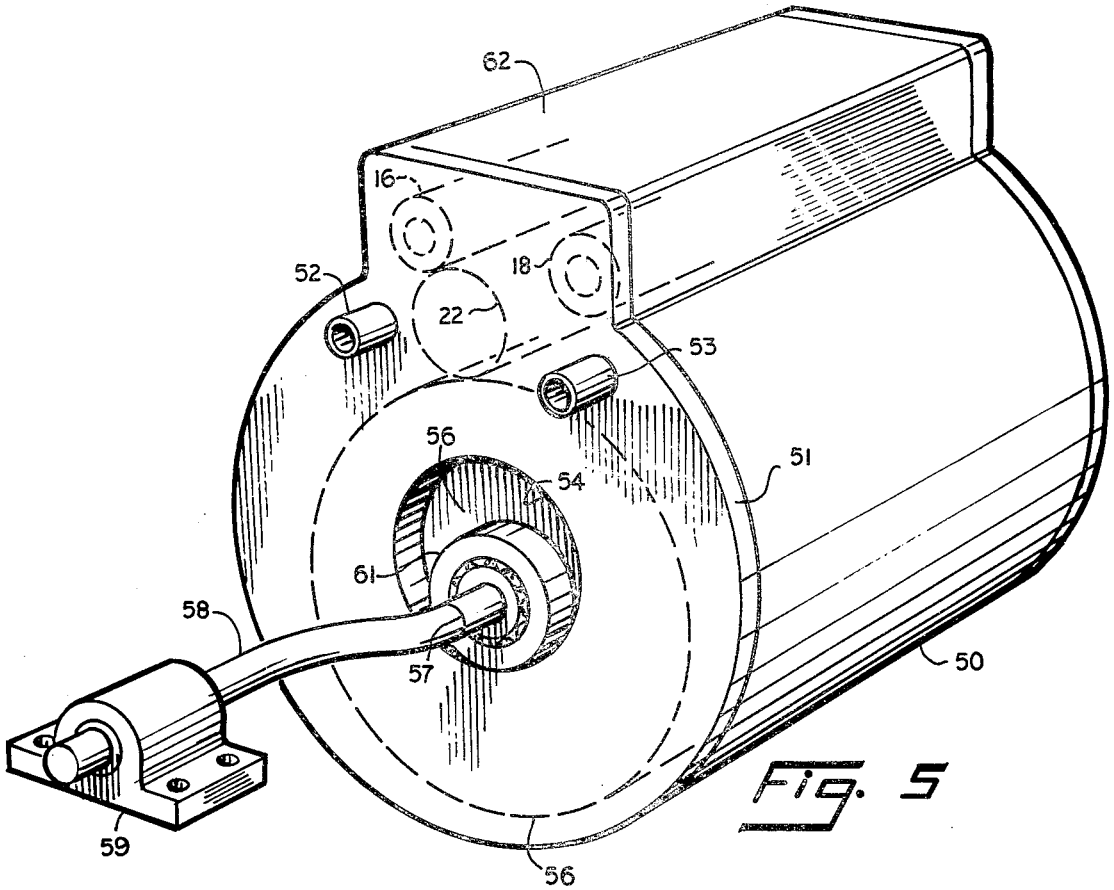
FIG. 5 is a three-dimensional view of still another modified form of the invention using a flexible shaft and inlet and outlet ports in the end plan.
Figure 6:
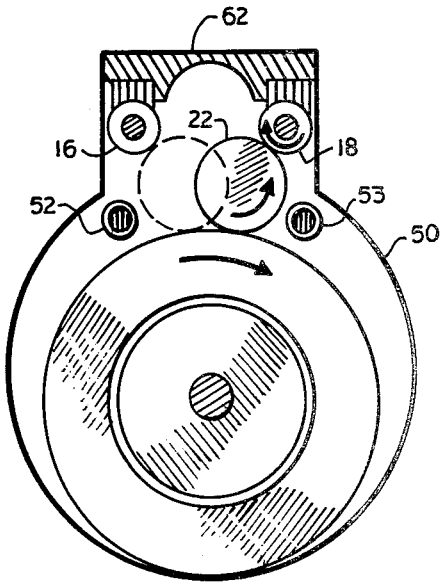
FIG. 6 is a fragmentary schematic diagram on an enlarged scale of the seal chamber of the modification of FIG. 5.

Referring now to FIGS. 5 and 6, there is illustrated still another modification wherein a housing 50 has an end plate 51 having two ports 52 and 53. The end plate 51 has a central aperture 54 through which is seen a rotor piston 56. Projecting from the rotor 56 is a stub shaft 57 connected to a flexible shaft 58, having its outer end secured in a bearing block 59. Surrounding the stub shaft 57 is a roller or ball bearing 61, the outer race of which engages the edges of the aperture 54. The aperture 54, therefore, acts as a bridge when the rotor 56 revolves to the region of a seal chamber 62. Disposed inside the seal chamber 62 is a seal cylinder 22, which, if desired, may rotate against rotatable support 16 and 18. The rolling seal 22 separates the two ports 52 and 53, and the machine of FIG. 5 operates in the same fashion as the machines of FIGS. 1 and 4.

The machine of FIGS. 5 and 6 has the same rolling contact of its piston cylinder 56 with the interior of the housing 50. The size of the aperture 54 and the bearing 61 is selected to ensure this rolling contact. The flexible shaft 58 bends to accommodate the revolutions of the piston 56 and takes off power when the machine is used as a motor and delivers power to the rotor when the machine is used as a compressor or pump.

If it is desired to avoid any possibility of the rotary piston from sliding on the inside of the housing (and thus inducing wear), positive rolling may be achieved by various structures such as gear teeth interengaging the housing and the rotor.

Figure 7:
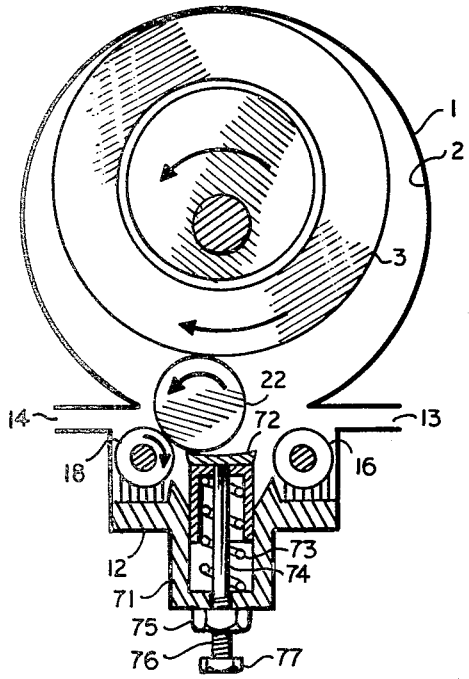
FIG. 7 is a schematic diagram of still another modification having a spring shoe in the seal chamber.

Illustrated in FIG. 7 is a machine similar to FIG. 1, but wherein the seal chamber is provided with a spring-biased shoe. This permits the machine to be operated with the seal chamber on the lower side so that gravity is not depended upon to maintain the seal cylinder in place when the machine is reversed or is switched from a motor to a compressor. The housing 1 contains the rotor 3, which rolls on the interior 2 of the housing 1. The seal cylinder 22 seals off the inlet 13 from the outlet 14 and may engage support 16 and 18. The seal chamber 12 has a projecting channel 71 which houses a shoe 72 urged inwardly by a compression spring 73. The shoe is secured to a reciprocating rod 74 passing through an externally threaded tube 76, which may be threaded inwardly or outwardly of the bell. The position of the tube 76 may be locked by a lock nut 75. On the lower end of the reciprocating shaft 74 is a head 77 which engages the outer end of the tube 76 to limit inward movement of the shoe 72.

The operation of the machine of FIG. 7 is similar to FIGS. 1 and 2 except that upon reversal of the machine (for example, by a valve 24 of FIG. 1) gravity will cause the seal cylinder 22 to try to drop downwardly. It will be engaged, however, by the shoe 72, which will maintain it in contact with the rotor 3. Upon reversal, gas pressure will move this seal cylinder 22 to the right in FIG. 7 until it engages the seal support 16, whereupon the machine is ready for reverse operation.

When the rotor of FIG. 7 revolves to its lowest position, the seal cylinder 22 will be driven downwardly against the shoe 72, which will retreat into the seal chamber 12 and rotate against the shoe. However, the pressure of the shoe need be just enough to support the weight of the seal cylinder 22, and friction will be light.

Referring to FIGS. 3 and 5, both the rim 15 of FIG. 3 and the bearing of FIG. 5 may be referred to as wheels that ride on their respective bridges 45 and 54. While the bearing 6 of FIG. 3 could suspend the rotor piston 3 from entering the seal chamber 12*a*, the wheel and bridge construction gives a smoother path. In FIG. 5 there is no suspension similar to the bearing 6 of FIG. 3, and the bridge and wheel construction alone prevents the rotor 3 from entering the seal chamber 12.

The following claims include all variations, modifications, and improvements that come within the true spirit and scope of the invention.

I claim:

1. Rolling rotor machine comprising:

(a) a housing having a cylindrical interior and an outwardly extending seal chamber parallel to the cylinder axis at one portion of the cylinder and having two sides parallel to said axis, said housing having an inlet port and outlet port;

(b) a cylindrical rotor piston having a diameter less than the interior diameter of the housing;

(c) means for rolling said piston around the interior of the housing;

(d) a rotating support having a fixed axis and disposed one at each side in the seal chamber and having a seal with the interior of said seal chamber;

(e) rolling seal cylinder disposed at said seal chamber and rolling on the piston and on the rotating support to seal the inlet from the outlet, said rolling seal having a diameter with respect to the housing seal chamber so that it can retreat into the seal chamber when the piston is rolling in the region of the seal chamber, said seal cylinder separating the inlet and outlet ports to thereby define working spaces between the piston and the housing, and the two rotating supports permitting the piston to roll in either direction.

2. A rolling rotor machine comprising:

(a) a housing having a cylindrical interior and an outwardly extending seal chamber parallel to the cylinder axis at one portion of the cylinder periphery and plates at each end of the cylinder, said housing having an inlet port and outlet port;

(b) a cylindrical rotor piston having a diameter less than the interior diameter of the housing;

(c) means for rolling said piston around the interior of the housing;

(d) a rolling seal cylinder disposed in said seal chamber and rolling on the rotor and against the interior of the seal chamber to seal the inlet from the outlet, said rolling seal having a diameter with respect to the housing seal chamber so that it can retreat into the seal chamber when the piston is rolling in the region of the seal chamber, said seal cylinder separating the inlet and outlet ports to thereby define working spaces between the rotor and the housing;

(e) a wheel secured to each end of the rotor piston;

(f) and a bridge formed on each end of the housing in the region of the seal chamber, each in line with its respective wheel, so that the wheels will ride on the bridges to prevent the rotor piston from entering the seal chamber.

3. A rolling rotor machine as set forth in claim 2 wherein the bridge is a hole in the end plates and the wheel is a bearing about the axis of rotation of the piston rotor and the bearing engages the hole when the piston revolves to the region of the seal chamber.

4. A rolling rotor maching comrising:

(a) a housing having a cylindrical interior and an outwardly extending seal chamber parallel to the cylinder axis at one portion of the cylinder periphery and plates at each end of the cylinder, said housing having an inlet port and outlet port;

(b) a cylindrical rotor piston having a diameter less than the interior diameter of the housing;

(c) means for rolling said piston around the interior of the housing;

(d) a rolling seal cylinder disposed in said seal chamber and rolling on the rotor and against the interior of the seal chamber to seal the inlet from the outlet, said rolling seal having a diameter with respect to the housing seal chamber so that it can retreat into the seal chamber when the piston is rolling in the region of the seal chamber, said seal cylinder separating the inlet and outlet ports to thereby define working spaces between the rotor and the housing;

(e) a rolling support secured to each end of the rotor piston;

(f) and a bridge formed on each end of the housing in the region of the seal chamber, each in line with its respective rolling support, so that the rolling supports will ride on the bridges to prevent the rotor piston from entering the seal chamber.

* * * * *